United States Patent [19]

Süss et al.

[11] 4,298,100

[45] Nov. 3, 1981

[54] SWITCHING APPARATUS FOR A GROUP OF ELEVATORS OR THE LIKE

[75] Inventors: Hans G. Süss, Udligenswil; Jiri Kiml, Ebikon, both of Switzerland

[73] Assignee: Inventio AG, Hergiswil, Switzerland

[21] Appl. No.: 96,982

[22] Filed: Nov. 23, 1979

[30] Foreign Application Priority Data

Dec. 12, 1978 [CH] Switzerland ..... 12630/78

[51] Int. Cl.[3] ..... B66B 1/20

[52] U.S. Cl. ..... 187/29 R

[58] Field of Search ..... 187/29

[56] References Cited

U.S. PATENT DOCUMENTS 3,236,332 2/1966 Burgy et al. ..... 187/29

4,147,235 4/1979 Henry et al. ..... 187/29

FOREIGN PATENT DOCUMENTS 52-27151 3/1977 Japan ..... 187/29

*Primary Examiner*—J. V. Truhe

*Assistant Examiner*—W. E. Duncanson, Jr.

*Attorney, Agent, or Firm*—Werner W. Kleeman

[57] ABSTRACT

A switching apparatus operatively associated with each elevator of an elevator group operated by means of a collective control and individual travel control serves the purpose, for instance in hospitals, of switching one or more elevators from one control mode to the other control mode. The switching apparatus comprises four series connected switching stages formed of digital logic or switching elements. By activating one of the key switches of the first switching stage there is initiated the switching operation to the relevant other operating mode, and there are generated signals which eliminate the elevator which is to be switched over from the storey call allocation. Upon arrival of an input information or signal which signals the operating state "free" of the elevator which is to be switched over, there is accomplished allocation to the desired operating mode by freeing the correlated door control by means of output signals produced in the second switching stage. A timing element of the third switching stage, after expiration of a control time, prior to allocation at the desired operating mode, generates a signal interrupting the cabin call transmitter supply. After servicing the last call which is located in the momentary travel direction of the cabin, the fourth switching stage produces a signal which extinguishes the still stored cabin calls and a signal which blocks the door closing operation until emptying of the elevator cabin.

8 Claims, 3 Drawing Figures

SWITCHING APPARATUS FOR A GROUP OF ELEVATORS OR THE LIKE

BACKGROUND OF THE INVENTION

The present invention relates to a new and improved construction of a switching apparatus for a group of elevators or lifts or the like, containing devices for a collective control and an individual travel control, and further has automatic doors, and wherein there are provided storey call storages which can be controlled by means of storey call transmitters and operatively associated with each control mode.

The purpose of such type switching apparatus is, for instance in the environment of hospitals, to switch one or a number of elevators of an elevator group from one type of control mode to the other control mode. The elevators for transporting individuals are operated by means of the collective control and for transporting beds and the like are operated by means of individual travel control rendering possible direct travel of the elevator to a given destination.

In German Pat. No. 2,418,129 there has been disclosed to the art an elevator installation for such type hybrid operation. Here, all of the elevators of the group continuously operate with the collective control as long as there is not required any transport of beds or the like between various floors or storeys of the building. The switching of an elevator from the collective control-operational mode to the individual travel control operational mode is accomplished by actuation of storey call transmitters which are associated with the individual travel control. These storey call transmitters however first then can be used after they have been activated by the approach of a bed by means of an inductive coil. With a bed call there is selected, to the extent available, a free elevator and allocated to the individual travel control. The report that the elevator is free is transmitted to a selection device, by means of which, also in the case of a number of free elevators, there is only freed one of the elevators for servicing the bed call. If there is not available a free elevator for servicing a bed call, then the next elevator which happens to pass the bed call-holding station, and which is in the process of transporting personnel, is stopped. With the aid of a suitable signal the traveling guests are requested to leave the elevator cabin. So that the transport of individuals i.e. passengers does not totally breakdown there is provided a limit device which can be set by a doorkeeper or other operating personnel, serving to limit the number of elevators which can be selected for transporting beds.

With such type elevator installation it is not possible to faultlessly separate the transport of beds from the transport of passengers. Thus, it is conceivable that passengers and beds mutually hinder one another before the doors of the elevator. Additionally, the passengers are forced to disembark from the elevator at landings or floors which they have not requested, so that depending upon the number of elevators which are still available for transferring passengers considerable time can elapse until he or she has reached the desired storey destination. What is also disadvantageous with this system is that, for the purpose of initiating the switching operation, it is necessary to provide at each storey or floor at least one induction coil or loop which activates the storey call transmitter of the individual travel control. A further drawback resides in the fact that with the presence of a number of free elevators there is not accomplished any group formation, so that in any event there is not insured the determination of the elevator cabin which in terms of its location is most favorable for servicing the call in question.

SUMMARY OF THE INVENTION

Therefore, with the foregoing in mind it is a primary object of the present invention to overcome the aforementioned drawbacks and limitations of the prior art proposals discussed above.

Another and more specific object of the present invention aims at providing a new and improved construction of switching apparatus for a group of elevators which are operated by means of a number of control modes, while overcoming the drawbacks discussed above.

Still a further significant object of the present invention aims at providing a new and improved construction of switching apparatus for a group of elevators allowing for more rational utilization of the elevators for different purposes, without inconveniencing or at least limiting the amount of inconvenience to which the passengers otherwise would be subjected with a system operation as contemplated by the prior art discussed above.

Now in order to implement these and still further objects of the invention, which will become more readily apparent as the description proceeds, the switching apparatus of the present development is manifested by the features that there is provided a first switching stage containing a switch producing two antivalent signals preventing the allocation of the storey calls correlated to the operation mode which is to be turned-off, to the elevator which is to be switched. This switching stage has arranged thereafter a second switching stage composed of a logic circuit which processes the antivalent signals. Delivered to the second switching stage are input information or signals which signal the operation mode of the elevator cabin. Connected after the second switching stage is a third switching stage. To the third switching stage there is infed a first output signal which is produced during switching at the second switching stage. Upon arrival of the input information of the second switching stage which signals the operating stage "free" of the switched-over elevator, there is generated a second and third output signal, by freeing the related door control, causing the allocation of the elevator to the selected operating mode. The third switching stage contains a timing element or timer which, after expiration of a control time, prior to allocation of the elevator to the other operating mode or state, generates a signal interrupting the cabin call transmitter supply. A fourth signal stage is provided, connected after the third signal stage, and generating further signals, by means of which, after servicing the last cabin call located in the momentary travel direction of the elevator cabin, there can be extinguished the still stored cabin calls and there can be blocked the door closing operation until emptying of the elevator cabin.

According to a preferred embodiment there is operatively associated with the operating mode for individual travel control which is to be turned-on and turned-off a group individual travel control which is exclusively correlated to the one access side of the elevator group, and the other access side of the elevator group has operatively correlated therewith the operating mode, group collective control.

According to a still further manifestation of the invention the switch of the first switching stage is constituted by a three-position-key switch (key-operated switch), wherein a switch contact associated with the first position and the one operating mode is connected with an input of a first NOR-element or gate and a switch contact associated with the second switch position and the other operating mode is connected with an input of a second NOR-element or gate. The output of the second NOR-gate is connected with a further input of the first NOR-element. A further input of the second NOR-element is connected with a contact of an automatic device which can be turned-on in the third position of the key switch. The output of the first NOR-element or gate forms, on the one hand, the first output and, on the other hand, by means of a NOT-element, the second output of the first switching stage.

The advantages which can be realized when practicing the invention particularly reside in the fact that, for each elevator of the group there is required only one switching apparatus, by means of which the elevator can have fixedly allocated thereto a certain operating mode. The three-position key switches are preferably, for instance, advantageously installed at the region of the area of the doorkeeper or operator's booth of a hospital and, as required, are operated by the doorkeeper or other hospital personnel, and the third position of the automatic switching can be accomplished according to, for instance, a clock program fixed for one week or according to the requirements of the momentarily prevailing traffic conditions at the hospital or other building with which the system is used. The switching operation which can be realized in stages or steps with the invention, renders it possible that after the switching there still can be serviced all of the cabin calls and after expiration of the control time there still can be serviced all of the cabin calls which are located in the momentary direction of travel of the elevator cabin, and only thereafter is there accomplished the allocation to the other operating mode. A further advantage which is attainable with the invention resides in the fact that, due to the correlation of the group collective control to the one access side and the correlation of the group individual travel control to the other access side of the elevator group, there is realized a faultless separation of the traffic flow. Furthermore, it is advantageous that by switching a number of elevators to individual travel control there can be formed a group which is linked by such control, and in each case there is available for the servicing of a bed call an elevator cabin which has been selected under optimum conditions.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
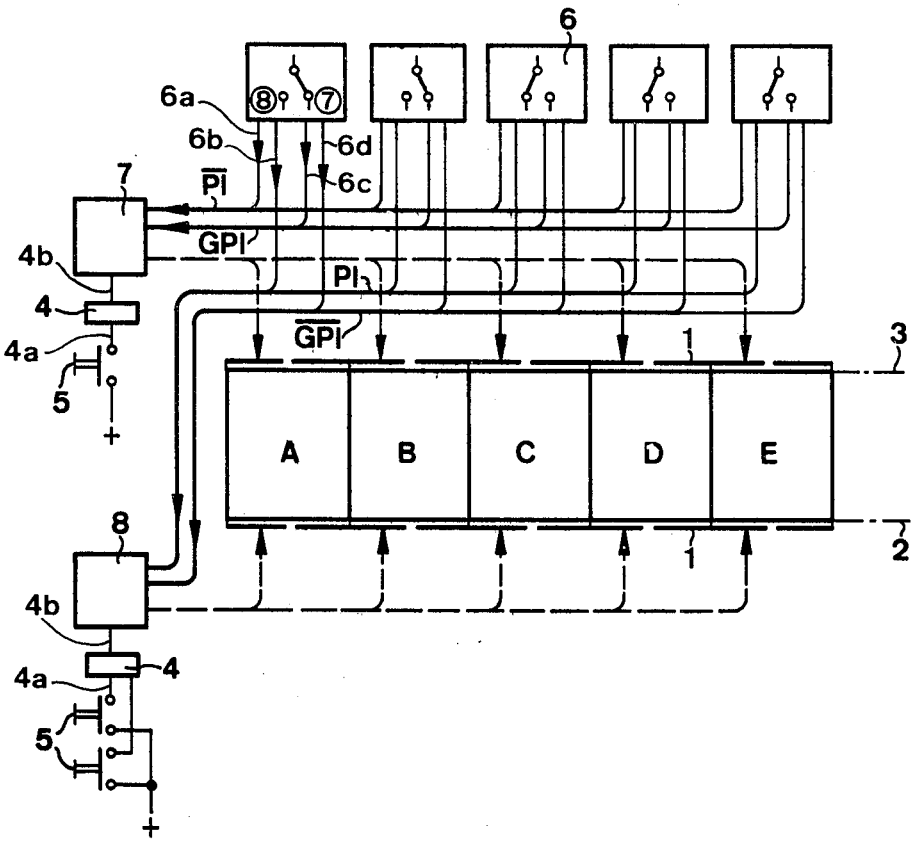
FIG. 1 is a block circuit diagram of an elevator group which has been schematically illustrated in plan view for purposes of explaining the invention.

Describing now the drawings, in FIG. 1 there have been designated by reference characters A, B, C, D and E five elevators of an elevator group, assumed to be installed for instance in a hospital. The elevators A, B, C, D and E possess oppositely situated access openings or entrances provided with automatic doors 1, wherein it is to be understood that the one side 2 which is accessible to the public serves for passenger traffic and the other internal side 3 which is not accessible to the public is reserved for transporting beds and goods and the like. Therefore, in the context of this disclosure reference to "transporting beds" is to be understood in its most broad sense as encompassing, not only the transporting of beds but other goods and the like between various storeys of the hospital or other building with which the equipment is used. The elevators A, B, C, D and E have correlated thereto, at each access side 2 and 3, storey call storages or memories 4 which are controlled by storey call transmitters 5 likewise arranged at both access sides 2 and 3. The storey call transmitters 5 are connected, on the one hand, with a not further illustrated suitable potential source, generally designated by a positive sign "+", and, on the other hand, with an input 4*a* of the storey call storage 4. The outputs 4*b* of the storey call storage 4 of the internal access side 3 are connected with an individual travel control device 7, whereas the outputs 4*b* of the storey call storages 4 of the publicly accessible side 2 are connected with a collective control device 8. The control devices 7 and 8 act upon the drive controls of the elevators A, B, C, D and E in conventional fashion. Reference character 6 designates switching devices, to be explained more fully hereinafter in conjunction with FIG. 2, which are operatively associated with each elevator or lift A, B, C, D and E of the elevator group. A first output 6*a* and a second output 6*b* of the switching devices 6 are connected with the individual travel control device 7 and the collective control device 8. A third output 6*c* and a fourth output 6*d* of the switching devices 6 are connected with the not here further illustrated drive controls, contained in the control devices 7 and 8, for the automatic doors 1 of the publicly accessible-access side 2 and the internally accessible-access side 3, respectively.

The individual travel control 7 is a control device of the type disclosed in greater detail in the commonly assigned, copending U.S. application Ser. No. 972,890, filed Dec. 26, 1978, entitled "Apparatus For Selecting A Storey Call At An Elevator System", to which reference may be readily had and the disclosure of which is incorporated herein by reference. This individual travel control 7 allocates the storey calls, in the timewise sequence in which they have been input, in each case to a free elevator cabin of an elevator group, this free elevator cabin being selected under optimum conditions. After the allocation operation has been accomplished the elevator cabin directly travels to the relevant storey or floor of the building.

The collective control 8 is a control device of the type disclosed in Swiss Pat. No. 387,903, to which reference may be likewise readily had and the disclosure of which is incorporated herein by reference. This collective control or collective control device 8 likewise determines an elevator cabin, selected under optimum conditions, for the servicing of a storey call. Upon travel of the elevator cabin to the relevant storey of the building there is, however, initially serviced, to the extent that any such calls are present, calls in the same direction between the elevator and the target storey.

Figure 2:
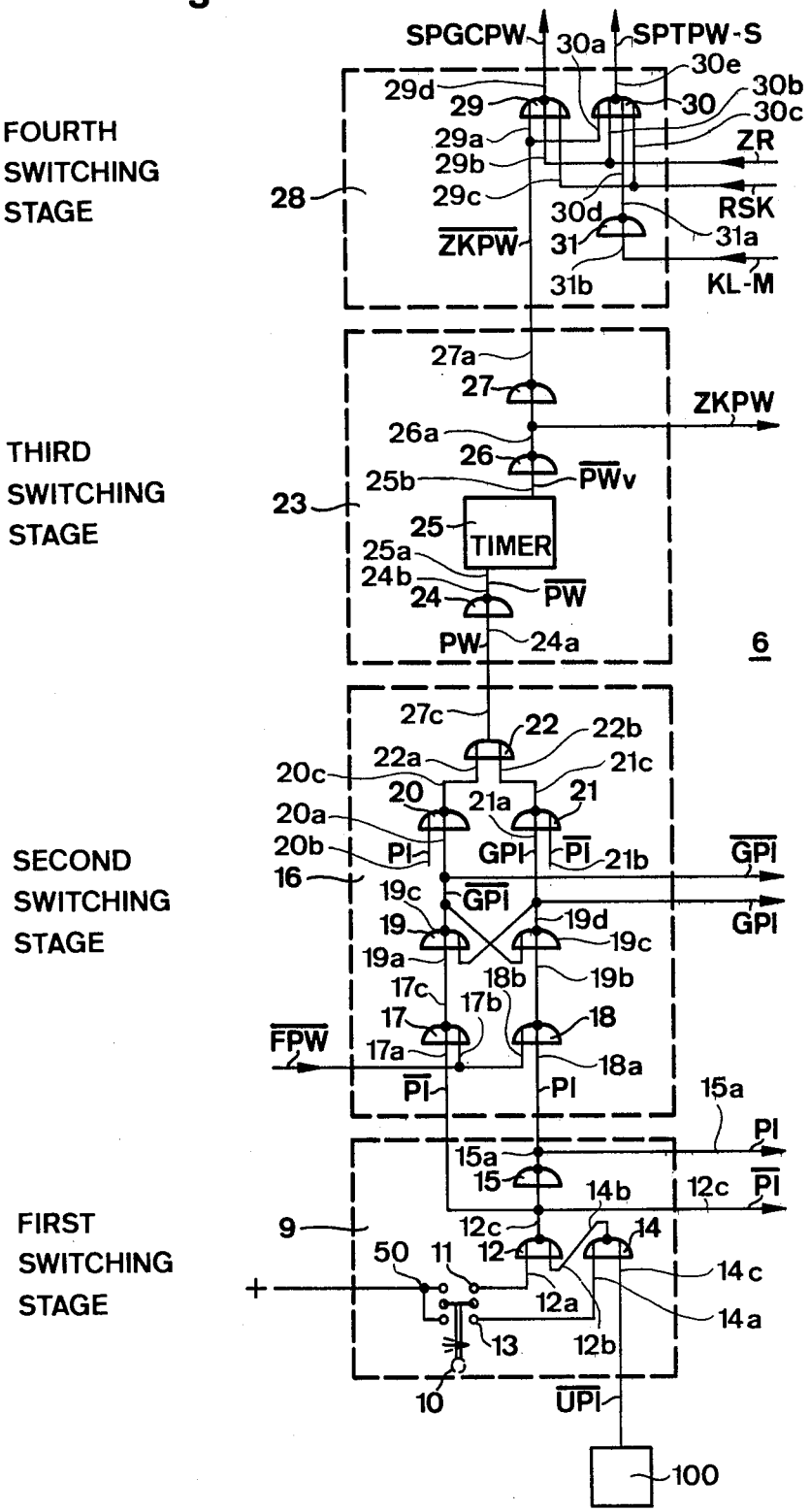
FIG. 2 is a circuit diagram of the inventive switching apparatus.

Continuing, reference character 9 designates, in FIG. 2, a first switching stage of the switching device or apparatus 6. This first switching stage 9 contains a three-position key-operated or key switch 10 of known construction, preferably installed at the doorkeeper's or porter's area or booth of a hospital by way of example. A switch contact 11 associated with the first switch position and the one operating mode is connected with an input 12*a* of a first NOR-element or gate 12. A switch contact 13 associated with the second switch position and the other operating mode is connected with an input 14*a* of a second NOR-element or gate 14. A switch contact 50, common to both switch positions, is connected with the merely schematically indicated voltage or potential source (+). The output 14*b* of the second NOR-gate 14 is connected with a further input 12*b* of the first NOR-element 12. A further input 14*c* the second NOR-element or gate 14 can be connected with a contact of a merely schematically illustrated but conventional program clock 100 which can be connected in the third switch position of the key switch 10. The first NOR-element 12 has connected thereafter a NOT-element or gate 15, and both of the outputs 12*c* and 15*a* of the NOR-element 12 and the NOT-element 15, respectively, form the outputs of the first switching stage 9 carrying the antivalent or Exclusive-Or signals PI, $\overline{PI}$.

Both of the outputs 12*c* and 15*a* of the first switching stage are connected, on the one hand, with the control devices 7 and 8, and, on the other hand, with a respective input 17*a* and 18*a* of a first NOR-element or gate 17 and a second NOR-element or gate 18, respectively, of a second switching stage 16. A respective further input 17*b* and 18*b* of the NOR-elements 17 and 18 have infed thereto an input information or signal $\overline{FPW}$ which signals the operating state of the elevator cabin. The outputs 17*c* and 18*c* of the NOR-elements 17 and 18, respectively, are connected with the inputs 19*a* and 19*b* of a storage 19 formed of two NOR-elements or gates 19*c*. The outputs 19*d* and 19*e* of the storage 9, carrying the antivalent or Exclusive-Or output signals GPI, $\overline{GPI}$ are connected, on the one hand, with the drive controls of the automatic doors 1 of the relevant elevator and, on the other hand, with a respective input 20*a* and 21*a* of a third NOR-element or gate 20 and a fourth NOR-element or gate 21. A respective further input 20*b* and 21*b* of the NOR-elements 20 and 21 have infed thereto the antivalent or Exclusive-Or output signals PI, $\overline{PI}$ of the first switching stage 9. The outputs 20*c* and 21*c* of the NOR-elements 20 and 21, respectively, are connected with the inputs 22*a* and 22*b* of an OR-element 22, the output 22*c* of which, carrying an output signal PW, is connected with an input 24*a* of a first NOT-element or gate 24 of a third switching stage 23.

The third switching stage 23 consists of a timing element or timer 25, whose input 25*a* is connected with the output 24*b* of the NOT-element 24 and whose output 25*b* is connected by means of a second NOT-element 26 and a third NOT-element 27 with an output 27*a* of the third switching stage 23. The output 26*a* of the second NOT-element or gate 26 forms a second output of the third switching stage 23 which carries a signal ZKPW. The timing element 25 is an electronic delay circuit of known construction containing adjustable cut-off delay.

Reference character 28 designates a fourth switching stage composed of a first NOR-element or gate 29 and a second NOR-element or gate 30 and a NOT-element or gate 31. A respective input 29*a* and 30*a* of the NOR-elements 29 and 30 is connected with the output 27*a* of the third switching stage 23 which carries the signal $\overline{ZKPW}$. A second respective input 29*b* and 30*b* and a third respective input 29*c* and 30*c* of the NOR-elements 29 and 30 have infed thereto the information or signals RSK and ZR, and a fourth input 30*d* of the second NOR-element 30 is connected with the output 31*a* of a NOT-element or gate 31, whose input 31*b* carries the information or signal KL-M. The outputs 29*d* and 30*e* of the NOR-elements or gates 29 and 30, respectively, simultaneously constitute the outputs of the fourth switching stage 28 and carry the information or signals SPGCPW and SPTPW-S serving for the switching operation.

The signals or information which have been referred to in the preceding description can, just as is conventional for logic states of digital circuits, assume the values "1" and "0" correlated to two different voltage levels and have the following significance:

PI, $\overline{PI}$: The antivalent signals produced upon actuation of the key switch 10, wherein with PI=1, $\overline{PI}$=0 there is initiated the allocation of the elevator to the individual travel control 7 and with $\overline{PI}$=1, PI=0 there is initiated the allocation of the elevator to the collective control 8.

UPI: The signal produced by the program clock 100 with the key switch 10 located in the third position.

FPW: The signal which signals the operating state of the elevator, wherein $\overline{FPW}$ assumes the logic state "1" as long as the elevator is not free, and with $\overline{FPW}$=0 (standstill of the elevator, empty cabin and closed doors) there is accomplished the allocation to the relevant other operating mode.

GPI, $\overline{GPI}$: The information or signals produced in the second switching stage 16, wherein with GPI=1 and $\overline{GPI}$=0 there is freed the door control of the access side correlated to the individual travel control 7 and with GPI=0 and $\overline{GPI}$=1 there is freed the door control of the access side correlated to the collective control 8.

PW: The output signal of the second switching stage 16, which during the transition phase assumes the logic state "1", wherein the transition phase begins with the switching time (signal change PI, $\overline{PI}$) and terminates with the allocation time ($\overline{FPW}$=0).

ZKPW, $\overline{ZKPW}$: The output information or signals of the third switching stage 23, wherein with ZKPW=1 there is interrupted the cabin call transmitter supply and with $\overline{ZKPW}$=0 there is prepared the change of the output information or signals of the fourth switching stage 28.

ZR: The input information or signal of the fourth switching stage 28, wherein ZR=0 when the elevator, in the travel direction, has serviced the last cabin call.

RSK: The input information of the fourth switching stage 28, wherein RSK=0 when the elevator stops.

KL-M: The minimum load information, the input information of the fourth switching stage 28, wherein KL-M=1 as long as the cabin is occupied.

SPGCPW: The cabin call extinguishing signal, the output signal of the fourth switching stage 28, wherein with the signal SPGCPW=1 all of the cabin calls are extinguished.

SPTPW-S: The output information of the fourth switching stage 28, wherein with the SPTPW-S=1 there is prevented closing of the doors.

Figure 3:
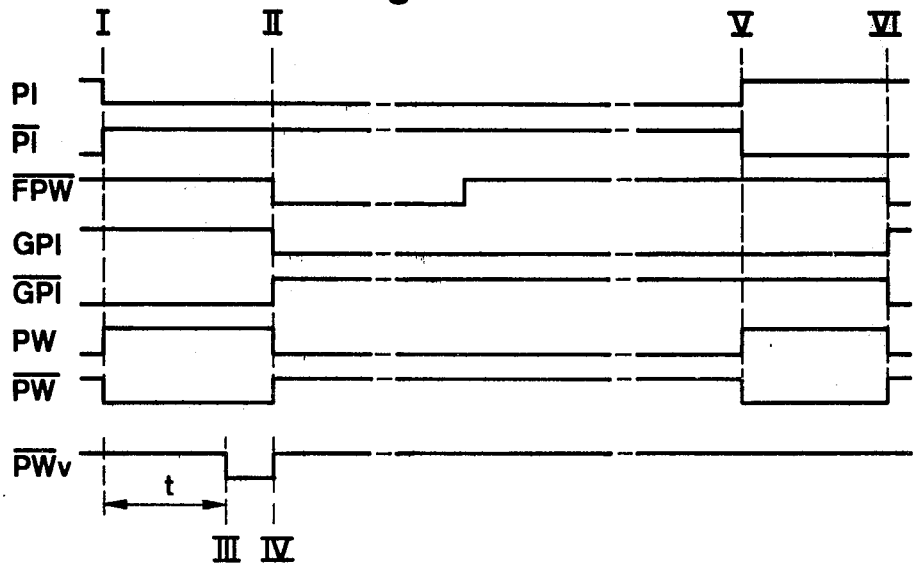
FIG. 3 is a signal-time diagram of the switching apparatus shown in FIG. 2.

The previously described switching apparatus functions in the following manner:

It is assumed that the elevators A, B, C are operated by means of the individual travel control 7 and the elevators D and E by means of the collective control 8, and that the elevator C, by operating the key switch 10, has been switched to the operating mode collective control (time I, FIG. 3). Furthermore, it is assumed that the elevator C at the same point in time is occupied ($\overline{FPW}=1$). With the signal or information $\overline{PI}=1$ there is brought about in any suitable manner that no storey or floor is serviced any longer at the internal side 3 of the elevator C which is correlated to the individual travel control 7. At the same time there is turned-off the optical and acoustical signaling of such elevator C at the internal side 3. Since the information $\overline{FPW}=1$, therefore the information or signals GPI, $\overline{GPI}$ at the outputs 19*d* and 19*e* of the storage 19 of the second switching stage 16 assume the logic states "1" and "0", respectively, with the result that the door control (broken lines of FIG. 1) is free and which acts upon the related door drive correlated to the internal access side 3 and there is blocked the door control correlated to the public access side 2. After completion of the travel of the elevator C, emptying of the cabin by means of the internal side 3 and closing of the doors 1, there prevails the information state or signal $\overline{FPW}=0$ (time II, FIG. 3), and thus, there are present the information or signals $\overline{GPI}=0$ and GPI=1, so that the door control of the public access side 2, correlated to the collective control 8, is free and the internal access side 3, correlated to the individual travel control 7, is blocked, whereby there is completed the switching operation.

During the transition phase between the switching (time I, FIG. 3) and the allocation to the other operating mode (time II, FIG. 3) the output information PW of the second switching stage 16 assumes the logic state "1" and the information or signal $\overline{PW}=0$ which is present at the input of the timing element 25 of the third switching stage 23. If the transition phase, and thus, the information $\overline{PW}=0$ is shorter than the delay time t set at the timing element 25, then the output information or signals of the timing element 25 and thus the third and fourth switching stages 23 and 28 do not change and have no effect upon the switching operation.

However, it has been assumed that the delay time t is smaller than the time duration of the transition phase, the elevator C therefore after expiration of the delay time t is still occupied (time III, FIG. 3). At this time the information PWv at the output of the timing element 25 assumes the logic state "0" the information ZKPW=1, with the result that in a not particularly further illustrated manner the cabin call transmitter supply is interrupted, so that no further cabin call can be accepted. With the information or signal ZKPW=1 the information ZKPW=0 and after the elevator C has serviced, in the direction of travel, the last cabin call and stops, there also prevail the signal conditions ZR=0 and RSK=0, so that the output information SGPCPW of the fourth switching stage 28 assumes the logic state "1", so that in likewise not further shown manner there is accomplished extinguishing of possibly not yet present cabin calls. If the elevator cabin is not emptied or if it is newly occupied, then with KL-M=1 the output information SPTPW-S=1, so that there is blocked door closing. After finally emptying the cabin towards the internal access side 3 there prevail the signal conditions KL-M=0 and SPTPW-S=0, so that the door closes and $\overline{FPW}=0$, GPI=0 and $\overline{GPI}=1$ (time IV, FIG. 3), so that the switching operation is completed and the elevator C has alllocated thereto the operating mode collective control.

At the points in time V and VI the elevator C is switched from the operating mode collective control to the operating mode individual travel control, and at the points in time I and II there occur the corresponding previously described operations.

It is also possible to allocate both operating modes both to the same entry or access side, and an additionally signaling is provided in order to channel the two traffic streams (bed transport and passenger transport).

The switching apparatus 6 can also be realized by means of other logic functions, by means of for instance NAND-logic configurations. It is also possible to realize the requisite switching functions with the aid of a microcomputer program.

Instead of the program clock of the exemplary embodiment discussed above, which switches at fixed times, it is possible to control the switching apparatus 6 by means of an apparatus which operates as a function of the encountered traffic. For this purpose there can be employed equipment similar to that disclosed in German Pat. No. 1,198,508, to which reference may be readily had and the disclosure of which is incorporated herein by reference, wherein control signals are produced as a function of the number of stored storey calls which are determined by counting.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. In a switching apparatus for a group of elevators containing devices for the control mode collective control and the control mode individual travel control and having automatic elevator cabin doors and wherein there are provided storey call storages controllable by means of storey call transmitters which are correlated to each control mode, comprising:

said control mode collective control being operatively correlated to a first access side of the elevators and the control mode individual travel control to a second access side of the elevators;

said first switching stage producing two non-equivalent signals preventing the allocation of the storey calls correlated to the operating mode which is to be turned-off to the elevator which is to be switched;

said first switching stage containing an input side and an output side;

a second switching stage having an input side connected with the output side of the first switching stage;

said second switching stage comprising logic circuitry for processing the non-equivalent signals;

means for infeeding input information to the second switching stage which signals one of the operating modes of the elevator cabin;

said second switching stage having an output;

a third switching stage having an input side connected with the output of the second switching stage;

said third switching stage having infed thereto a first output signal produced upon switching in the second switching stage;

said second switching stage producing a second output signal and third output signal which by freeing a related door control of the elevator causes allocation of the elevator to the selected operating mode when said infeeding means infeeds input information signaling the operating mode "free" of the elevator to be switched;

said third switching stage having an output side and containing a timing element which after expiration of a predetermined control time, prior to allocation of the elevator to the other operating mode, produces a signal interrupting the cabin call transmitter supply; and a fourth switching stage connected with the output side of the third switching stage for producing further signals, by means of which, after servicing the last cabin call located in the momentary direction of travel of the elevator cabin, extinguishes the still stored cabin calls and blocks the door closing operation until emptying of the elevator cabin.

2. The switching apparatus as defined in claim 1, wherein:

the operating mode individual travel control which is to be turned-on and turned-off has allocated thereto a group individual travel control correlated to one access side of the elevator group; and a group travel control constituting an operating mode allocated to another access side of the elevator group.

3. The switching apparatus as defined in claim 1, wherein:

said switch of the first switching stage comprises a three-position key-operated switch;

said key-operated switch having a switch contact correlated to a first position thereof and one operating mode;

said first switching stage containing a first NOR-gate and a second NOR-gate;

each of said NOR-gates having inputs and outputs;

said switch contact being connected in a first position of the three-position key-operated switch with a first input of the first NOR-gate;

a further switch contact correlated to a second position of the key-operated switch and the other operating mode;

said further switch contact being connected with an input of the second NOR-gate;

said second NOR-gate having an output connected with a further input of the first NOR-gate;

a further input of the second NOR-gate being connected with an automatic means which can be switched in a third position of the key-operated switch; and said output side of said first switching stage containing a first output and a second output;

said output of the first NOR-gate being connected with the first output of the first switching stage and by means of a NOT-gate with the second output of the first switching stage.

4. The switching apparatus as defined in claim 3, wherein:

said second switching stage comprises:

a storage composed of two NOR-elements;

said NOR-elements having inputs and outputs;

a first NOR-element and a second NOR-element having inputs and outputs;

respective inputs of said two NOR-elements being connected with respective outputs of the first and second NOR-elements;

said inputs of the first and second NOR-elements defining respective first inputs and second inputs;

the first inputs of the first and second NOR-elements being connected with the outputs of the first switching stage;

the second inputs of the first and second NOR-elements carrying said input information;

the outputs of the storage carrying the second and third output signal being connected with a respective input of a third and fourth NOR-element;

said third and fourth NOR-elements having second inputs connected with the outputs of the first switching stage;

said third and fourth NOR-elements having outputs; and the outputs of the third and fourth NOR-elements forming by means of an OR-element the output of the second switching stage which carries the first output signal.

5. The switching apparatus as defined in claim 4, wherein:

the third switching stage contains a timing element which comprises a delay circuit having cut-off time delay;

said timing element having an input connected by means of a first NOT-element thereof with the output of the second switching stage carrying the first output signal;

said timing element having an output side forming by means of a second NOT-element a first output of the third switching stage and by means of a third NOT-element connected after the second NOT-element forming a second output of the third switching stage.

6. The switching apparatus as defined in claim 5, wherein:

the fourth switching stage comprises a first NOR-element and a second NOR-element;

each of said first and second NOR-elements having inputs and outputs;

the first inputs of the first and second NOR-elements being connected with the second output of the third switching stage and second and third inputs of said first and second NOR-elements having infed thereto second and third input information;

a NOT-element having an input and output;

a fourth input of said second NOR-element being connected with the output of said NOT-element;

said NOT-element having its input carrying further input information; and the outputs of the NOR-elements forming outputs of the fourth switching stage which carry further signals.

7. The switching apparatus as defined in claim 3, wherein:

said automatic means comprises a program clock actuating the switching apparatus according to a fixed program.

8. The switching apparatus as defined in claim 3, wherein:

said automatic means comprises means for controlling the switching apparatus as a function of the prevailing traffic.

* * * * *